United States Patent [19]

Marino

[11] 4,282,562

[45] Aug. 4, 1981

[54] COMBINATION RECHARGEABLE FLASHLIGHT AND CHARGER BASE

[76] Inventor: James Marino, R.D. #1; Box 192A, Asbury, N.J. 08802

[21] Appl. No.: 89,560

[22] Filed: Oct. 29, 1979

[51] Int. Cl.[3] ..... F21L 7/00

[52] U.S. Cl. ..... 362/183; 362/202; 362/398

[58] Field of Search ..... 362/183, 398

[56] References Cited

U.S. PATENT DOCUMENTS 3,787,678 1/1974 Rainer ..... 362/183

*Primary Examiner*—Stephen J. Lechert, Jr.

*Attorney, Agent, or Firm*—Norman N. Popper; Daniel H. Bobis

[57] ABSTRACT

A combination rechargeable flashlight and charger base comprising a flashlight with a particularly shaped enlargement thereon and a charger base with a correspondingly particularly shaped socket thereon; the enlargement on the flashlight and the socket on the charger base correspond closely with each other and interfit with each other; the enlargement on the flashlight has a magnet applied thereto and the socket in the charger base has magnetic material therein for magnetic interengagement with the magnet when the enlargement is interfitted with the socket on the charger base.

7 Claims, 8 Drawing Figures

COMBINATION RECHARGEABLE FLASHLIGHT AND CHARGER BASE

BACKGROUND OF THE INVENTION

1. FIELD OF THE INVENTION:

This invention relates generally to combination rechargeable flashlights and a charger base and particularly to a rechargeable flashlight having a particularly shaped enlargement thereon and a charger base having a particularly shaped corresponding socket thereon.

2. PRIOR ART:

Various forms of flashlights with provisions for recharging batteries therein have been devised. But in many cases, the arrangement for positioning the flashlight for recharging is difficult, awkward and inconvenient; the interfitting contacts are uncertain and do not provide certain and firm recharging contact. The release of the flashlight from the recharger after recharging may be awkward and inconvenient. The recharging unit is of such design that it may be difficult to position and conveniently locate and its bulk and complexity detract from its utility.

SUMMARY OF THE INVENTION

It has been found that a simple recharger base can be constructed with a particularly shaped socket thereon, and a flashlight can be devised with a particularly shaped corresponding enlargement thereon so that the socket and enlargement may be interfitted with each other and thereby provide precise registration of recharging contacts on the flashlight with those on the charger base. To ensure continuous and firm recharging contact of the respective contacts on the flashlight in the charger base, the enlargement on the flashlight is provided with a magnet and a corresponding piece of magnetic material is positioned in the socket in the charger base whereby the flashlight and the recharger base are intimately held in magnetic contact with each other with the respective corresponding charger contacts firmly engaged. The enlargement and the socket may be shaped in such a manner that they may only be interfitted with each other in one way so that there will never be a problem of improper polarity. However, if the enlargement and the socket can be interfitted in two ways, a unidirectional conduction device may be connected in the flashlight in series with one of the recharging circuits so that if reverse polarity does arise, no current will be passed and the batteries will not be discharged.

THE DRAWINGS

These objects and advantages as well as other objects and advantages may be obtained by the device shown by way of illustration in the drawings in which.

PREFERRED EMBODIMENT

Figure 1:
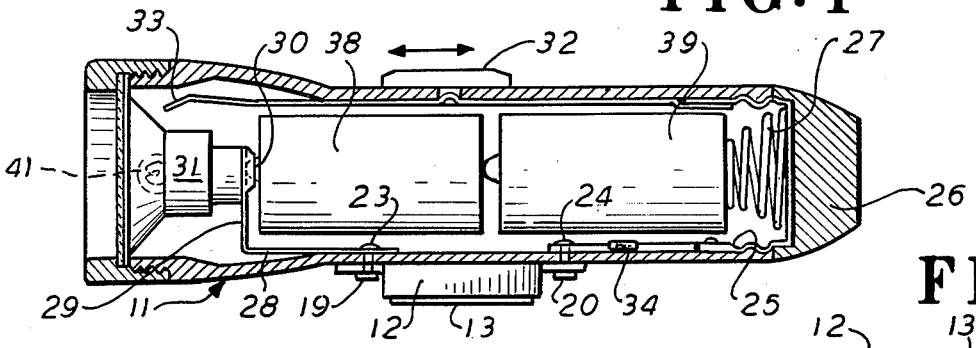
FIG. 1 is an exploded view of the flashlight.
Figure 2:
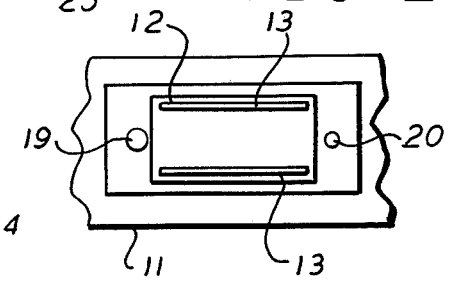
FIG. 2 is a bottom view of the mating enlargement in the flashlight.
Figure 3:
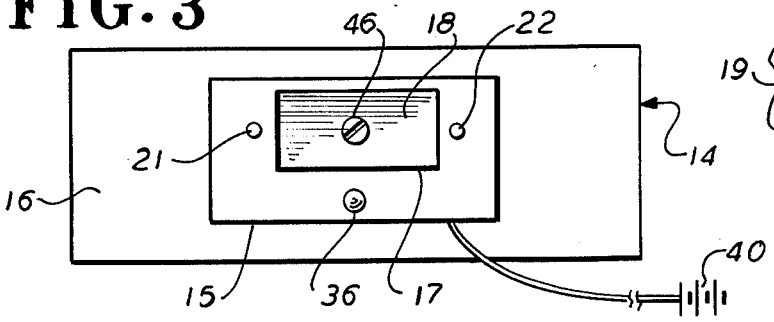
FIG. 3 is a top plan view of the socket on the recharger base.
Figure 5:
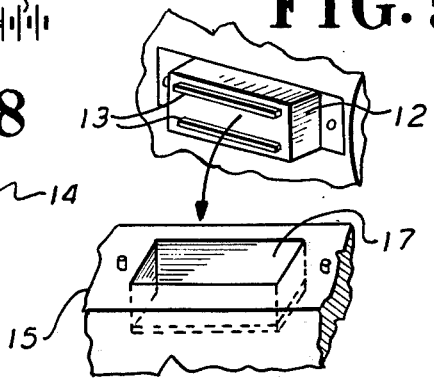
FIG. 5 is a view of the enlargement, displaced from the socket.
Figure 8:
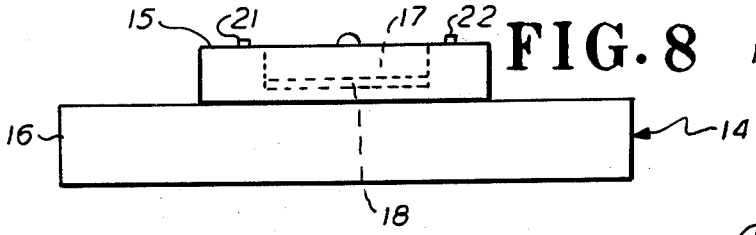
FIG. 8 is a side elevational view of the recharger base.
Figure 6:
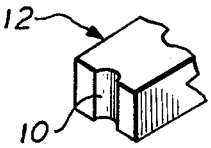
FIG. 6 is a view of an irregular enlargement.
Figure 7:
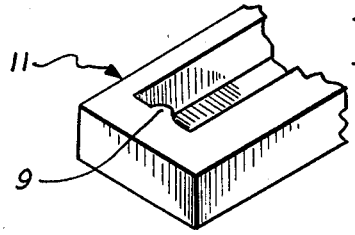
FIG. 7 is a view of a mating irregular socket.
Figure 4:
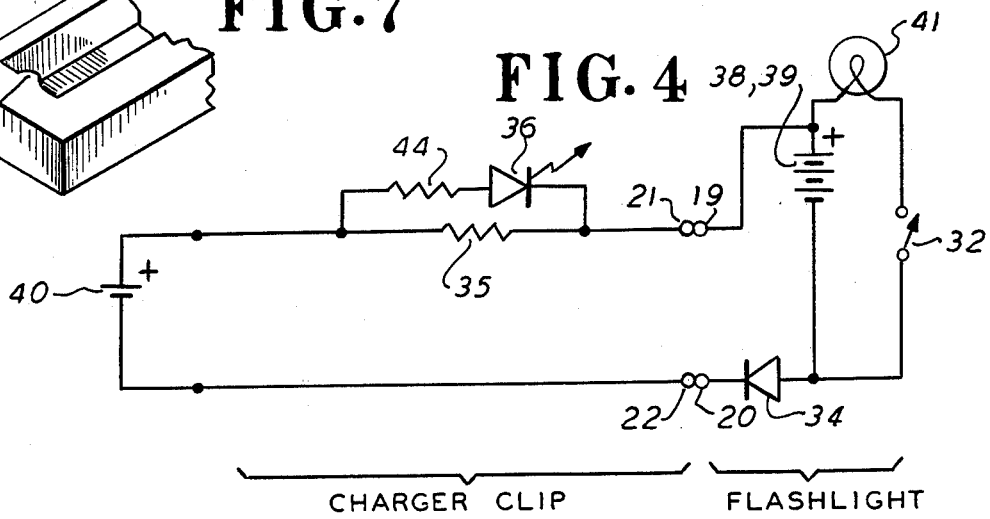
FIG. 4 is a circuit diagram.

The combination rechargeable flashlight and charger base provides a flashlight 11. There is a shaped enlargement 12 attached to the outside of the flashlight 11. This enlargement 12 is a housing for a pair of magnets 13, 13. The enlargement 12 shown by way of illustration is rectangular but it may have an irregular shape, like a keyway 10 as in FIG. 6, to mate with the rib 9 as in FIG. 7. The shape of the enlargement 12 may have importance if it is desirable to ensure that the polarity be of a certain character when the enlargement 12 is fitted into a socket. Thus an irregular shape will ensure that the enlargement 12 can only be fitted into the socket in one particular way thereby ensuring polarity of the proper character. The rectangular enlargement is however chosen for purposes of illustrating the invention.

A charger base 14 which is separate from the flashlight 11 is provided. This base 14 is shown by way of illustration to have two rectangular portions 15, 16 superposed on each other. The upper rectangular portion 15 of the charger base 14 is provided with a shaped socket 17 which is so shaped and dimensioned so that it will receive the shaped enlargement 12 and will interfit closely, the one with the other. The shaped socket 17 has a ferro-magnetic piece 18 at the bottom of the socket 17. This magnetic piece 18 is positioned for engagement with the magnet 13 on the enlargement 12 when the enlargement 12 and the socket 17 are interfitted with each other. A screw 46 may be used to hold the portions 15, 16 together.

Immediately adjacent to the enlargement 12, a first pair of contacts 19, 20 are externally exposed on the flashlight and these provide the means for a charging current to be introduced into the body of the flashlight for the purpose of recharging the battery therein. On the charger base 14, a second pair of contacts 21, 22 are provided in general registration with the pair of contacts 19 and 20 on the flashlight, so that when the enlargement 12 is interfitted with the socket 17 the first pair of contacts 19, 20 on the flashlight will be opposite to and will electrically engage with the second pair of contacts 21, 22 on the base. Such engagement will arise only when the enlargement 12 is interfitted with the socket 17.

The external charging contacts 19, 20 on the flashlight 11 have internal pairs of contacts 23, 24. The one internal contact 24 is connected with a base ring 25 which is threaded and, is engaged with a bottom cap 26. The bottom cap 26 has a spring 27 engaged with it, which spring normally establishes contact with the bottom of a battery, or negative post. The other internal contact 23, which is connected to the external contact 19, has a strip 28 connected to it. The strip 28 has an offset end 29, which extends over the positive pole of the battery. The end 29 has downturned edges 30 defining a cup like contact for the positive pole of the battery.

Contact with a lamp socket 31 is established by engagement of a portion of the socket with the offset 29 and power to the lamp 41 in the socket is provided by an external switch 32 which moves a contact finger 33 into engagement with the other side of the lamp socket 31. In series with the connection to the base ring 25 and the contact 24, there is a safety diode 34 to prevent the reverse charging of the batteries in the flashlight in the event that the normal recharging circuit is accidentally reversed. A resistor 35 is connected in series with the power input circuit in order to match the charging input to the batteries. Likewise, a light emitting diode 36 is connected in parallel with the resistence 35 to indicate when current is flowing in the charging circuit and the batteries 38, 39 are being recharged. The light diode 36 will indicate this. The second pair of contacts 21, 22 are connected with the power supply 40. A resistor 44 is connected in series with the diode 36. Recharging power is provided by the battery 40, for the nickel-cadmium flashlight batteries 38, 39.

What is claimed is:

1. A combination rechargeable flashlight and flashlight battery recharger base comprising, (a) a flashlight, (b) a shaped enlargement thereon, (c) a magnet on the shaped enlargement for affirmatively engaging the flashlight with a socket, (d) a charger base, (e) a shaped socket on the charger base, (f) the shaped enlargement on the flashlight and the shaped socket in the charger base interfitting closely with each other, (g) a magnetic piece in the shaped socket magnetically engageable with the magnet on the enlargement when the enlargement and the socket are interfitted with each other.

2. A combination rechargeable flashlight and flashlight battery recharger base according to claim 1 and, (a) a first pair of contacts externally exposed on the flashlight, (b) a second pair of contacts externally exposed on the base, (c) the first and second pairs of contacts engageable with each other when the shaped enlargement and the shaped socket are interfitted with each other.

3. A combination rechargeable flashlight and flashlight battery recharger base according to claim 2 and, (a) third pairs of contacts in the flashlight for engagement each respectively with the opposite poles of a battery in the flashlight, (b) the third pair of contacts in the flashlight connected to the first pairs of contacts.

4. A combination rechargeable flashlight battery recharger base according to claim 3 and, (a) the second pair of contacts connected to a power source for recharging the battery in the flashlight.

5. A combination rechargeable flashlight and flashlight battery recharger base according to claim 4 and, (a) a unidirectional conductor means in one of the connections of the third pair of contacts to the first pair of contacts to prevent reverse polarity connection and power flow from the power source to the battery.

6. A combination rechargeable flashlight and flashlight battery recharger base according to claim 3 and, (a) a first resistence in the recharger base in series with the connection to the power source to match the power supply to the flashlight battery, (b) a lamp and a resistence in series with the connection of the power source to the flashlight to light up as a signal that the charging circuit is active.

7. A combination rechargeable flashlight and flashlight battery recharger base according to claim 1 and, (a) a contact in the flashlight for the positive pole of a battery wherein the end of the contact is offset and provided with turned over edges to cup the positive pole of the battery.

* * * * *